US009595235B2

(12) United States Patent
Xiao

(10) Patent No.: US 9,595,235 B2
(45) Date of Patent: Mar. 14, 2017

(54) SCAN DRIVING CIRCUIT OF REDUCING CURRENT LEAKAGE

(71) Applicant: SHENZHEN CHINA STAR OPTOELECTRONICS TECHNOLOGY CO., LTD., Shenzhen, Guangdong (CN)

(72) Inventor: Juncheng Xiao, Shenzhen (CN)

(73) Assignee: SHENZHEN CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 58 days.

(21) Appl. No.: 14/417,132

(22) PCT Filed: Nov. 20, 2014

(86) PCT No.: PCT/CN2014/091729

§ 371 (c)(1),
(2) Date: Jan. 23, 2015

(87) PCT Pub. No.: WO2016/074269

PCT Pub. Date: May 19, 2016

(65) Prior Publication Data

US 2016/0140926 A1 May 19, 2016

(30) Foreign Application Priority Data

Nov. 14, 2014 (CN) ..... 2014 1 0650003

(51) Int. Cl.
*G09G 3/36* (2006.01)

(52) U.S. Cl.
CPC ... *G09G 3/3677* (2013.01); *G09G 2310/0248* (2013.01); *G09G 2310/0267* (2013.01);
(Continued)

(58) Field of Classification Search
CPC ..... G09G 3/3266; G09G 3/3259; G09G 3/3274–3/3291; G09G 3/02–3/0216;
(Continued)

(56) References Cited

U.S. PATENT DOCUMENTS

2012/0153996 A1* 6/2012 Su ..... G09G 3/3659 327/109
2012/0242630 A1 9/2012 Ohara
(Continued)

FOREIGN PATENT DOCUMENTS

CN 103680453 A 3/2014
CN 103928008 A 7/2014
(Continued)

*Primary Examiner* — Sanghyuk Park

(57) ABSTRACT

A scan driving circuit includes a pull controlling module for generating scan level signal based on transferring signals from the previous one stage and from the previous two stage, a pull-up module, a pull-down module, a pull-down holding module, a transferring module, a first bootstrap capacitor, a constant low voltage level source, and a second bootstrap capacitor for pulling up the scan level signal through the transferring signal from the previous one stage. The present invention upgrades a reliability of the scan driving circuit.

19 Claims, 3 Drawing Sheets

(52) U.S. Cl.
CPC ..... *G09G 2310/061* (2013.01); *G09G 2320/0214* (2013.01)

(58) Field of Classification Search
CPC .. G09G 3/0262–3/0267; G09G 3/0281; G09G 3/0283; G09G 3/0219
See application file for complete search history.

(56) References Cited

U.S. PATENT DOCUMENTS

| | | | | |
|---|---|---|---|---|
| 2013/0093743 | A1* | 4/2013 | Takahashi ..... | G09G 3/3677 345/211 |
| 2015/0279288 | A1 | 10/2015 | Dai et al. | |

FOREIGN PATENT DOCUMENTS

| | | | |
|---|---|---|---|
| CN | 104064160 | A | 9/2014 |
| JP | 2008131407 | A | 6/2008 |
| WO | 2011080936 | A1 | 7/2011 |

* cited by examiner

SCAN DRIVING CIRCUIT OF REDUCING CURRENT LEAKAGE

BACKGROUND OF THE INVENTION

1. Field of the Invention

The present invention relates to display drives, and more specifically, to a scan driving circuit.

2. Description of the Prior Art

A Gate Drive On Array (GOA) is to fabricate scan drivers on a thin film transistor (TFT) array substrate of a liquid crystal display so as to drive a plurality of scan lines. Referring to FIG. 1, a conventional scan driving circuit comprises a pull controlling module 101, a pull-up module 102, a transferring model 103, a pull-down module 104, bootstrap capacitor 105 and a pull-down holding module 106.

When the scan driving circuit 10 is operating in a high temperature, the threshold voltage of transistors would gradually become negative, leading to a tendency of current leakage of transistors on each module, thus undermine the reliability of the scan driving circuit.

Therefore, it is necessary to propose another scan driving circuit to solve the existing problems of the current technology.

SUMMARY OF THE INVENTION

An object of the present invention is to provide a more reliable scan driving circuit that is less likely to leak, so to solve the technical problem with the conventional scan driving circuit, which is more likely to leak and therefore unreliable.

According to the present invention, a scan driving circuit for driving a plurality of scan lines comprises:

a pull controlling module for receiving a transferring signal from a previous one stage and a transferring signal from a previous two stage, and for generating scan level signal based on the transferring signal from the previous one stage and the transferring signal from the previous two stage;

a pull-up module, for pulling up scan signal of one of the plurality of scan lines based on the scan level signal and a clock signal at a current stage;

a pull-down module, for pulling down the scan signal based on a transferring signal of a next stage;

a pull-down holding module, for holding the scan signal at a low level;

a transferring module, for sending a transferring signal of the current stage to a pull controlling module at the next stage;

a first bootstrap capacitor, for generating a high voltage level for the scan signal;

a constant low voltage level source for supplying low voltage level to pull down; and a reset module for reset operation of the scan level signal at the current stage;

wherein the pull controlling module comprises:

a second bootstrap capacitor for pre-pulling up the scan level signal through the transferring signal from the previous two stage, and pulling up the scan level signal through the transferring signal from the previous one stage;

a first transistor, comprising a controlling terminal receiving the transferring signal from the previous one stage, an input terminal connecting to the second bootstrap capacitor, and an output terminal connecting to the pull-up module, the pull-down module, the pull-down holding module, the transferring module and the second bootstrap capacitor.

In another aspect of the present invention, the pull controlling module further comprises a pre-pulling transistor and a pulling transistor;

a controlling terminal of the pre-pulling transistor is coupled to the transferring signal of the previous two stage, an input terminal of the pre-pulling transistor is coupled to the transferring signal of the previous two stage, and an output terminal of the pre-pulling transistor is connected to one end of the second bootstrap capacitor and the input terminal of the first transistor;

a controlling terminal of the pulling transistor is coupled to the transferring signal of the previous one stage; an input terminal of the pulling transistor is coupled to the transferring signal of the previous one stage, and an output terminal of the pulling transistor is connected to the other end of the second bootstrap capacitor.

In another aspect of the present invention, the pull-up module comprises a second transistor comprising a controlling terminal connecting to the output terminal of the first transistor of the pull controlling module, an input terminal for receiving the clock signal of the current stage, and an output terminal for outputting the scan signal of the current stage.

In another aspect of the present invention, the transferring module comprises a third transistor comprising a controlling terminal connecting to the output terminal of the first transistor of the pull controlling module, an input terminal for receiving the clock signal of the current stage, and an output terminal for outputting the transferring signal of the current stage.

In another aspect of the present invention, the pull-down module comprises a fourth transistor comprising a controlling terminal for receiving the transferring signal of the next stage, an input terminal connecting to the output terminal of the first transistor of the pull controlling module, and an output terminal connecting to the constant low voltage level source.

In another aspect of the present invention, the pull-down module comprises a fifth transistor comprising a controlling terminal for receiving the transferring signal of the next stage, an input terminal connecting to the output terminal of the third transistor, and an output terminal connecting to the constant low voltage level source.

In another aspect of the present invention, the pull-down holding module comprises a first pull-down holding unit, a second pull-down holding unit, a twenty-second transistor and a twenty-third transistor;

the twenty-second transistor comprises a controlling terminal connected to the output terminal of the first transistor, an output terminal connected to a reference point K(N), and an input terminal connected to a reference point P(N);

the twenty-third transistor comprises a controlling terminal receiving the transferring signal of the previous stage, an output terminal connected to the reference point K(N), and an input terminal connected to the reference point P(N);

the first pull-down holding unit comprises a sixth transistor, a seventh transistor, an eighth transistor, a ninth transistor, a tenth transistor, an eleventh transistor, a twelfth transistor, and a thirteenth transistor;

the sixth transistor comprises a controlling terminal connected to the reference point K(N), an input terminal connected to the constant low voltage level source, and an output terminal connected to the output terminal of the second transistor;

the seventh transistor comprises a controlling terminal connected to the reference point K(N), an input terminal connected to the constant low voltage level source, and an output terminal connected to the output terminal of the first transistor;

the eighth transistor comprises a controlling terminal connected to the reference point K(N), an input terminal connected to the constant low voltage level source, and an output terminal coupled to the transferring signal of the current stage;

the ninth transistor comprises a controlling terminal coupled to a first pulse signal, an input terminal coupled to the first pulse signal, and an output terminal connected to the reference point K(N);

the tenth transistor comprises a controlling terminal coupled to the transferring signal of the current stage, an input terminal connected to the constant low voltage level source, and an output terminal coupled to the first pulse signal;

the eleventh transistor comprises a controlling terminal coupled to a second pulse signal, the input terminal coupled to the first pulse signal, and an output terminal connected to the reference point K(N);

the twelfth transistor comprises a controlling terminal connected to the reference point K(N), an output terminal connected to reference point K(N), and an input terminal coupled to the first pulse signal;

the thirteenth transistor comprises a controlling terminal receiving the transferring signal of the previous stage, an input terminal coupled to the first pulse signal, and an output terminal coupled to the second pulse signal;

the second pull-down holding unit comprises a fourteenth transistor, a fifteenth transistor, a sixteenth transistor, a seventeenth transistor, an eighteenth transistor, a nineteenth transistor, a twentieth transistor, and a twenty-first transistor;

the fourteenth transistor comprises a controlling terminal connected to the reference point P(N), an input terminal connected to the constant low voltage level source, and an output terminal connected to the output terminal of the second transistor;

the fifteenth transistor comprises a controlling terminal connected to the reference point P(N), an input terminal connected to the constant low voltage level source, and an output terminal connected to the output terminal of the first transistor;

the sixteenth transistor comprises a controlling terminal connected to the reference point P(N), an input terminal connected to the constant low voltage level source, and an output terminal coupled to the transferring signal of the current stage;

the seventeenth transistor comprises a controlling terminal coupled to the second pulse signal, an input terminal coupled to the second pulse signal, and an output terminal connected to the reference point P(N);

the eighteenth transistor comprises a controlling terminal coupled to the transferring signal of the current stage, an input terminal connected to the constant low voltage level source, and an output terminal coupled to the second pulse signal;

the nineteenth transistor comprises a controlling terminal connected to the first pulse signal, an input terminal coupled to the second pulse signal, and an output terminal connected to the reference point P(N);

the twentieth transistor comprises a controlling terminal connected to the reference point P(N), an output terminal connected to the reference point P(N), and an input terminal coupled to the second pulse signal;

the twenty-first transistor comprises a controlling terminal receiving the transferring signal of the previous stage, an input terminal coupled to the second pulse signal, and an output terminal coupled to the first pulse signal.

In still another aspect of the present invention, a voltage level of the first pulse signal is opposite to a voltage level of the second pulse signal.

In yet another aspect of the present invention, the first pulse signal and second pulse signal are high frequency pulse signal or low voltage level signal.

According to the present invention, a scan driving circuit for driving a plurality of scan lines comprises:

a pull controlling module for receiving a transferring signal from a previous one stage and a transferring signal from a previous two stage, and for generating scan level signal based on the transferring signal from the previous one stage and the transferring signal from the previous two stage;

a pull-up module, for pulling up scan signal of one of the plurality of scan lines based on the scan level signal and a clock signal at a current stage;

a pull-down module, for pulling down the scan signal based on a transferring signal of a next stage;

a pull-down holding module, for holding the scan signal at a low level;

a transferring module, for sending a transferring signal of the current stage to a pull controlling module at the next stage;

a first bootstrap capacitor, for generating a high voltage level for the scan signal; and a constant low voltage level source for supplying low voltage level to pull down;

wherein the pull controlling module comprises:

a second bootstrap capacitor for pre-pulling up the scan level signal through the transferring signal from the previous two stage, and pulling up the scan level signal through the transferring signal from the previous one stage;

In one aspect of the present invention, the pull controlling module further comprises:

a first transistor, comprising a controlling terminal receiving the transferring signal from the previous one stage, an input terminal connecting to the second bootstrap capacitor, and an output terminal connecting to the pull-up module, the pull-down module, the pull-down holding module, the transferring module and the second bootstrap capacitor.

In another aspect of the present invention, the pull controlling module further comprises a pre-pulling transistor and a pulling transistor;

a controlling terminal of the pre-pulling transistor is coupled to the transferring signal of the previous two stage, an input terminal of the pre-pulling transistor is coupled to the transferring signal of the previous two stage, and an output terminal of the pre-pulling transistor is connected to one end of the second bootstrap capacitor and the input terminal of the first transistor;

a controlling terminal of the pulling transistor is coupled to the transferring signal of the previous one stage; an input terminal of the pulling transistor is coupled to the transferring signal of the previous one stage, and an output terminal of the pulling transistor is connected to the other end of the second bootstrap capacitor.

In another aspect of the present invention, the pull-up module comprises a second transistor comprising a controlling terminal connecting to the output terminal of the first transistor of the pull controlling module, an input terminal for receiving the clock signal of the current stage, and an output terminal for outputting the scan signal of the current stage.

In another aspect of the present invention, the transferring module comprises a third transistor comprising a controlling terminal connecting to the output terminal of the first transistor of the pull controlling module, an input terminal for receiving the clock signal of the current stage, and an output terminal for outputting the transferring signal of the current stage.

In another aspect of the present invention, the pull-down module comprises a fourth transistor comprising a controlling terminal for receiving the transferring signal of the next stage, an input terminal connecting to the output terminal of the first transistor of the pull controlling module, and an output terminal connecting to the constant low voltage level source.

In another aspect of the present invention, the pull-down module comprises a fifth transistor comprising a controlling terminal for receiving the transferring signal of the next stage, an input terminal connecting to the output terminal of the third transistor, and an output terminal connecting to the constant low voltage level source.

In another aspect of the present invention, the pull-down holding module comprises a first pull-down holding unit, a second pull-down holding unit, a twenty-second transistor and a twenty-third transistor;

the twenty-second transistor comprises a controlling terminal connected to the output terminal of the first transistor, an output terminal connected to a reference point K(N), and an input terminal connected to a reference point P(N);

the twenty-third transistor comprises a controlling terminal receiving the transferring signal of the previous stage, an output terminal connected to the reference point K(N), and an input terminal connected to the reference point P(N);

the first pull-down holding unit comprises a sixth transistor, a seventh transistor, an eighth transistor, a ninth transistor, a tenth transistor, an eleventh transistor, a twelfth transistor, and a thirteenth transistor;

the sixth transistor comprises a controlling terminal connected to the reference point K(N), an input terminal connected to the constant low voltage level source, and an output terminal connected to the output terminal of the second transistor;

the seventh transistor comprises a controlling terminal connected to the reference point K(N), an input terminal connected to the constant low voltage level source, and an output terminal connected to the output terminal of the first transistor;

the eighth transistor comprises a controlling terminal connected to the reference point K(N), an input terminal connected to the constant low voltage level source, and an output terminal coupled to the transferring signal of the current stage;

the ninth transistor comprises a controlling terminal coupled to a first pulse signal, an input terminal coupled to the first pulse signal, and an output terminal connected to the reference point K(N);

the tenth transistor comprises a controlling terminal coupled to the transferring signal of the current stage, an input terminal connected to the constant low voltage level source, and an output terminal coupled to the first pulse signal;

the eleventh transistor comprises a controlling terminal coupled to a second pulse signal, the input terminal coupled to the first pulse signal, and an output terminal connected to the reference point K(N);

the twelfth transistor comprises a controlling terminal connected to the reference point K(N), an output terminal connected to reference point K(N), and an input terminal coupled to the first pulse signal;

the thirteenth transistor comprises a controlling terminal receiving the transferring signal of the previous stage, an input terminal coupled to the first pulse signal, and an output terminal coupled to the second pulse signal;

the second pull-down holding unit comprises a fourteenth transistor, a fifteenth transistor, a sixteenth transistor, a seventeenth transistor, an eighteenth transistor, a nineteenth transistor, a twentieth transistor, and a twenty-first transistor;

the fourteenth transistor comprises a controlling terminal connected to the reference point P(N), an input terminal connected to the constant low voltage level source, and an output terminal connected to the output terminal of the second transistor;

the fifteenth transistor comprises a controlling terminal connected to the reference point P(N), an input terminal connected to the constant low voltage level source, and an output terminal connected to the output terminal of the first transistor;

the sixteenth transistor comprises a controlling terminal connected to the reference point P(N), an input terminal connected to the constant low voltage level source, and an output terminal coupled to the transferring signal of the current stage;

the seventeenth transistor comprises a controlling terminal coupled to the second pulse signal, an input terminal coupled to the second pulse signal, and an output terminal connected to the reference point P(N);

the eighteenth transistor comprises a controlling terminal coupled to the transferring signal of the current stage, an input terminal connected to the constant low voltage level source, and an output terminal coupled to the second pulse signal;

the nineteenth transistor comprises a controlling terminal connected to the first pulse signal, an input terminal coupled to the second pulse signal, and an output terminal connected to the reference point P(N);

the twentieth transistor comprises a controlling terminal connected to the reference point P(N), an output terminal connected to the reference point P(N), and an input terminal coupled to the second pulse signal;

the twenty-first transistor comprises a controlling terminal receiving the transferring signal of the previous stage, an input terminal coupled to the second pulse signal, and an output terminal coupled to the first pulse signal.

In another aspect of the present invention, a voltage level of the first pulse signal is opposite to a voltage level of the second pulse signal.

In still another aspect of the present invention, the first pulse signal and second pulse signal are high frequency pulse signal or low voltage level signal.

In yet another aspect of the present invention, the scan driving circuit further comprises a reset module for reset operation of the scan level signal at the current stage.

Comparing to the prior art, the scan driving circuit of the present invention utilizes a second bootstrap capacitor in the pull controlling module, so to avoid leakage and enhance the reliability of the scan driving circuit. It solves the technical problem of the tendency to leakage that undermines the reliability of the circuit.

DETAILED DESCRIPTION OF THE PREFERRED EMBODIMENTS

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures.

It is noted that the same components are labeled by the same number.

Figure 1:
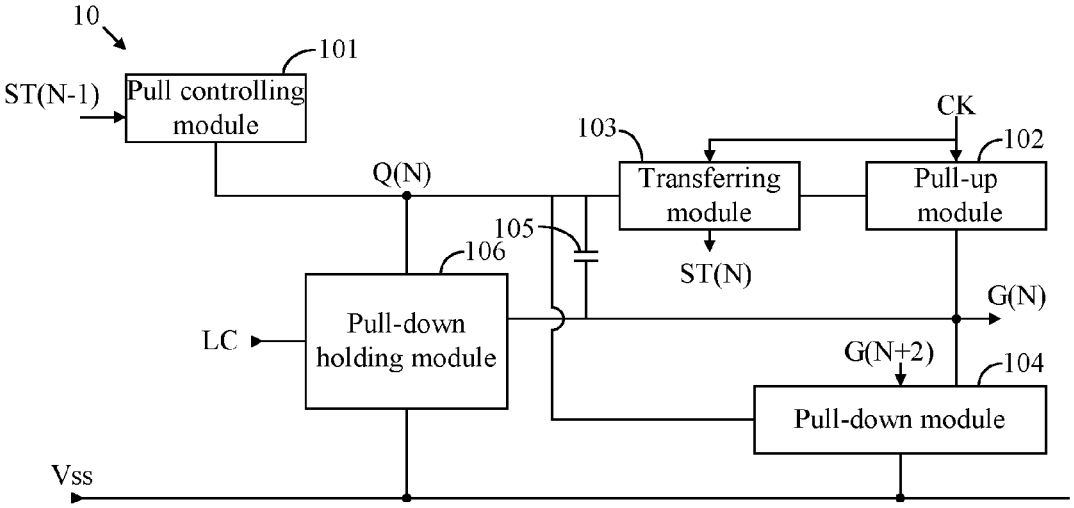
Fig. 1 (Prior art)
FIG. 1 shows a block diagram of a convention scan driving circuit.
Figure 2:
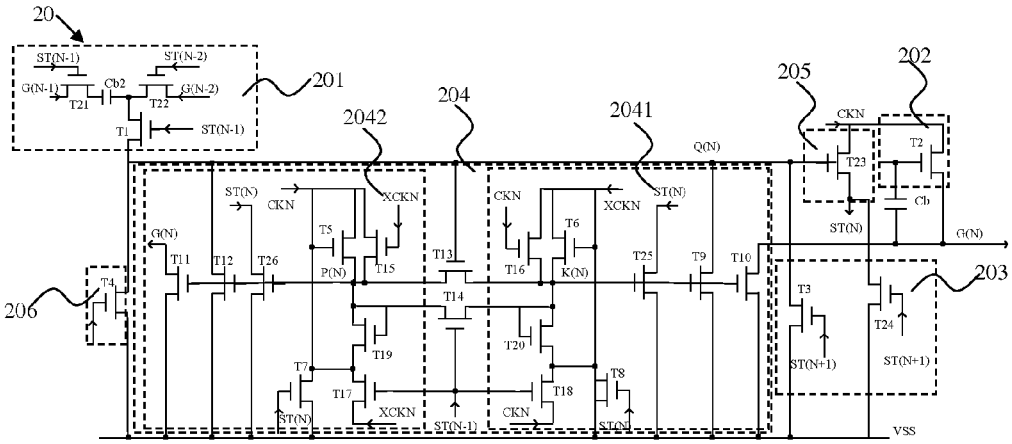
FIG. 2 is a circuit diagram of a scan driving circuit according to a first preferred embodiment of the present invention.
Figure 3:
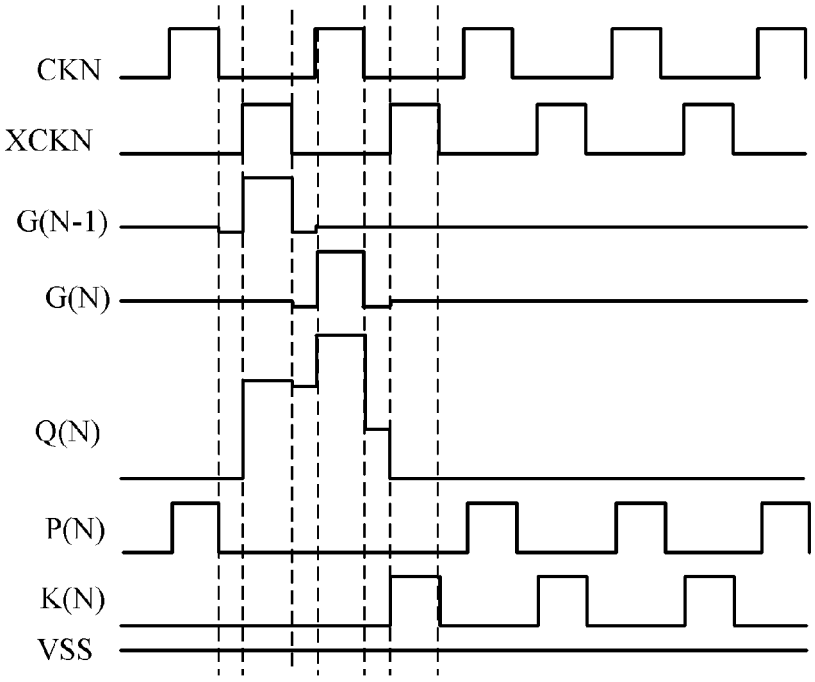
FIG. 3 shows waveforms of signals applied on the scan driving circuit according to the first preferred embodiment of the present invention.

Please refer to FIG. 2 and FIG. 3. FIG. 2 is a circuit diagram of a scan driving circuit according to a first preferred embodiment of the present invention. FIG. 3 shows waveforms signals applied on the scan driving circuit according to the first preferred embodiment of the present invention. A scan driving circuit 20 comprises a pull controlling module 201, a pull-up module 202, a pull-down module 203, a pull-down holding module 204, a transferring module 205, a first capacitor Cb and a constant low voltage level source VSS. The pull controlling module 201 is used for receiving a transferring signal ST(N−1) of the previous one stage, and a transferring signal ST(N−2) of the previous two stage, and generating scan level signal Q(N) based on the transferring signal ST(N−1) of the previous one stage and the transferring signal ST(N−2) of the previous two stage. The pull-up module 202 is used for pulling up a scan signal G(N) based on the scan level signal Q(N) and a clock signal CKN of the current stage. The pull-down module 203 is used for pulling down a scan signal G(N) based on a transferring signal ST(N+1) of the next stage. The pull-down holding module 204 is used for holding the scan signal G(N) at a low level. The transferring module 205 is used for outputting a transferring signal ST(N) of the current stage to the pull controlling module 201 of the next stage. The first bootstrap capacitor Cb is disposed between an output terminal of the first transistor T1 and an output terminal of a second transistor T2, so as to generate a high voltage level for the scan signal G(N). The constant low voltage level source VSS is used to supply low voltage level for pulling down.

The pull controlling module 201 comprises a second bootstrap capacitor Cb2, a first transistor T1, a pre-pulling transistor T22 and a pulling transistor T21. The second bootstrap capacitor Cb2 pre-pulls the scan level signal Q(N) through the transferring signal ST(N−2) of the previous two stage, and pulls up a scan level signal Q(N) through the transferring signal ST(N−1) of the previous one stage.

The first transistor T1 comprises a controlling terminal receiving the transferring signal ST(N−1) of the previous one stage, an input terminal connected to the second bootstrap capacitor Cb2, and an output terminal connected to the pull-up module 202, the pull-down module 203, the pull-down holding module 204, the transferring module 205 and the first bootstrap capacitor Cb. The pre-pull transistor T22 comprises a controlling terminal coupled to a transferring signal ST(N−2) of the previous two stage, an input terminal coupled to a scan signal G(N−2) of the previous two stage, and an output terminal connected to one end of the second bootstrap capacitor Cb2 and the input terminal of the first transistor T1. The pulling transistor T21 comprises a controlling terminal coupled to a transferring signal ST(N−1) of the previous one stage, an input terminal coupled to a scan signal G(N−1) of the previous one stage, and an output terminal connected to another end of the second bootstrap capacitor Cb2.

The pull-up module 202 comprises a second transistor T2 comprising a controlling terminal connected to the output terminal of the first transistor T1 of the pull controlling module 201, an input terminal receiving a clock signal CK(N) of the current stage, and an output terminal outputting the scan signal G(N) of the current stage.

The transferring module 205 comprises a third transistor T23 comprising a controlling terminal connected to the output terminal of the first transistor T1 of the pull controlling module 201, an input terminal receiving a clock signal CK(N) of the current stage, and an output terminal outputting a transferring signal ST(N) of the current stage.

The pull-down module 203 comprises a fourth transistor T3. The fourth transistor T4 comprises a controlling terminal receiving a transferring signal ST(N+1) of the next stage, an input terminal connected to the output terminal of the first transistor T1 of the pull controlling module 201, and an output terminal connected to the constant low voltage level source VSS.

The pull-down module 203 comprises a fifth transistor T42. The fifth transistor T42 comprises a controlling terminal receiving the transferring signal ST(N+1) of the next stage, an input terminal connected to the output terminal of the third transistor T23, and an output terminal connected to the constant low voltage level source VSS.

The pull-down holding module 204 comprises a first pull-down holding unit 2041, a second pull-down holding unit 2042, a twenty-second transistor T13 and a twenty-third transistor T14.

The twenty-second transistor T13 comprises a controlling terminal connected to the output terminal of the first transistor T1, an output terminal connected to a reference point K(N), and an input terminal connected to a reference point P(N).

The twenty-third transistor T14 comprises a controlling terminal receiving the transferring signal ST(N−1) of the previous stage, an output terminal connected to the reference point K(N), and an input terminal connected to the reference point P(N).

The first pull-down holding unit 2041 comprises a sixth transistor T10, a seventh transistor T9, an eighth transistor T25, a ninth transistor T6, a tenth transistor T8, an eleventh transistor T16, a twelfth transistor T20, and a thirteenth transistor T18.

The sixth transistor T10 comprises a controlling terminal connected to the reference point K(N), an input terminal connected to the constant low voltage level source VSS, and an output terminal connected to the output terminal of the second transistor T2.

The seventh transistor T9 comprises a controlling terminal connected to the reference point K(N), an input terminal connected to the constant low voltage level source VSS, and an output terminal connected to the output terminal of the first transistor T1.

The eighth transistor T25 comprises a controlling terminal connected to the reference point K(N), an input terminal connected to the constant low voltage level source VSS, and an output terminal coupled to the transferring signal ST(N) of the current stage.

The ninth transistor T6 comprises a controlling terminal coupled to a first high frequency pulse signal XCKN, an input terminal coupled to the first high frequency pulse signal XCKN, and an output terminal connected to the reference point K(N).

The tenth transistor T8 comprises a controlling terminal coupled to the transferring signal ST(N) of the current stage, an input terminal connected to the constant low voltage level source VSS, and an output terminal coupled to the first high frequency pulse signal XCKN.

The eleventh transistor T16 comprises a controlling terminal coupled to a second high frequency pulse signal CKN, an input terminal coupled to the first high frequency pulse signal XCKN, and an output terminal connected to the reference point K(N).

The twelfth transistor T20 comprises a controlling terminal connected to the reference point K(N), an output terminal connected to the reference point K(N), and an input terminal couple to the second high frequency pulse signal CKN.

The thirteenth transistor T18 comprises a controlling terminal receiving the transferring signal ST(N−1) of the previous one stage, an input terminal coupled to the first high frequency pulse signal XCKN, and an output terminal coupled to the second high frequency pulse signal CKN.

The second pull-down holding unit comprises a fourteenth transistor T11, a fifteenth transistor T12, a sixteenth transistor T26, a seventeenth transistor T5, an eighteenth transistor T7, a nineteenth transistor T15, a twentieth transistor T19, and a twenty-first transistor T17.

The fourteenth transistor T11 comprises a controlling terminal connected to the reference point P(N), an input terminal connected to the constant low voltage level source VSS, and an output terminal connected to the output terminal of the second transistor T2.

The fifteenth transistor T12 comprises a controlling terminal connected to the reference point P(N), an input terminal connected to the constant low voltage level source VSS, and an output terminal connected to the output terminal of the first transistor T1.

The sixteenth transistor T26 comprises a controlling terminal connected to the reference point P(N), an input terminal connected to the constant low voltage level source VSS, and an output terminal coupled to the transferring signal ST(N) of the current stage.

The seventeenth transistor T5 comprises a controlling terminal coupled to the second high frequency pulse signal CKN, an input terminal connected to the second high frequency pulse signal CKN, and an output terminal connected to the reference point P(N).

The eighteenth transistor T7 comprises a controlling terminal coupled to the transferring signal ST(N) of the current stage, an input terminal connected to the constant low voltage level source VSS, and an output terminal couple to the second high frequency pulse signal CKN.

The nineteenth transistor comprises a controlling terminal coupled to the first high frequency pulse signal XCKN, an input terminal coupled to the second high frequency pulse signal CKN, and an output terminal connected to the reference point P(N).

The twentieth transistor T19 comprises a controlling terminal connected to the reference point P(N), an output terminal connected to the reference point P(N), and an input terminal coupled to the second high frequency pulse signal CKN.

The twenty-first transistor T17 comprises a controlling terminal receiving the transferring signal ST(N−1) of the previous stage, an input terminal coupled to the second high frequency pulse signal CKN, and an output terminal coupled to the first high frequency pulse signal XCKN.

The voltage level of the first pulse signal XCKN is opposite to the voltage level of the second pulse signal CKN.

Preferably, the scan driving circuit 20 further comprises a reset module 206 for resetting the scan level signal Q(n) of the current stage. The reset module 206 comprises a transistor T4. Resetting the scan level signal Q(n) (i.e. the reference point Q(n)) is done by inputting high voltage level signal to the controlling terminal of the transistor T4.

Please refer to FIG. 2 for the operation of the scan driving circuit 20 of the preferred embodiment. When the transferring signal ST(N−2) of the previous two stage is at a high voltage level, the scan signal G(N−2) of the previous two stage is also at a high voltage level. The pre-pulling transistor T22 is turned on, and the scan signal G(N−2) of the previous two stage charges the second bootstrap capacitor Cb2 through the pre-pulling transistor T22, so that voltage applied on one end of the second bootstrap capacitor Cb2 raises to a first voltage level high. Afterwards, the transferring signal ST(N−1) of the previous one stage becomes at high voltage level, and the scan signal G(N−1) of the previous one stage becomes at high voltage level as well. Meanwhile, the pulling transistor T21 is turned on, and the scan signal G(N−1) of the previous one stage charges the second bootstrap capacitor Cb2 through the pulling transistor T21, so that voltage applied on the other end of the second bootstrap capacitor Cb2 raises to a second high voltage level larger than the first high voltage level.

Afterwards, the first transistor T1 is turned on in response to the transferring signal ST(N−1) of the previous one stage. Voltage applied on the second bootstrap capacitor Cb2 charges the first bootstrap capacitor Cb through the first transistor T1, so that the reference point Q(n) can be raised to a higher voltage level. Then, the transferring signal ST(N−1) of the previous one stage becomes at a low level, disconnecting the first transistor T1. The reference point Q(n) holds at a higher voltage level through the first bootstrap capacitor Cb. The second transistor T2 and the third transistor T23 are turned on.

Afterwards, the clock signal CK(n) of the current stage becomes at a high voltage level, and continues to charge the first bootstrap capacitor Cb through the second transistor T2, leading to a higher voltage level applied on the reference point Q(n). The scan signal G(N) of the current stage and the transferring signal ST(N) of the current stage also become at a high voltage level.

Reference point Q(n) is now at a high voltage level. Because the input terminal of the first transistor T1 is connected to the second bootstrap capacitor Cb2, a voltage drop of the reference point Q(n) will not occur through the first transistor T1.

Meanwhile, because the twenty-second transistor T13 is turned on, the first pull-down holding unit 2041 or the second pull-down holding unit 2042 can hold the high voltage level applied on the reference point Q(n) under the effect of the first high frequency pulse signal XCKN and the second high frequency pulse signal CKN.

When the first high frequency pulse signal XCKN is at a high voltage level and the second high frequency pulse signal CKN is at a low voltage level, the nineteenth transistor T15, the ninth transistor T6 and the eighteenth transistor T7 are turned on, and the reference point K(N) and reference point P(n) become at a low voltage level through the nineteenth transistor T15 and the eighteenth transistor T7. Thus, the sixth transistor T10, the seventh transistor T11, the eighth transistor T25, the fourteenth transistor T11, the fifteenth transistor T12, and the sixteenth transistor T26 are turned off, holding the high voltage level of the reference point Q(n), the transferring signal ST(N) of the current stage and the scan signal G(N) of the current stage.

When the first high frequency pulse signal XCKN is at a low voltage level, and the second high frequency pulse signal CKN is at a high voltage level, the seventeenth transistor T5, eleventh transistor T16 and the tenth transistor T8 are turned on, and the reference point K(N) and P(n) become at a low voltage level through the eleventh transistor T16 and the tenth transistor T8. Thus, the sixth transistor T10, the seventh transistor T11, the eighth transistor T25, the fourteenth transistor T11, the fifteenth transistor T12 and the sixteenth transistor T26 are turned off, holding the high voltage level of the reference point Q(n), the transferring signal ST(N) of the current stage and the scan signal G(N) of the current stage.

When the transferring signal ST(N+1) of the next stage becomes at a high voltage level, the fourth transistor T3 is turned on, the reference point Q(n) becomes at a low voltage level, and thus the twenty-second transistor T13 is turned off.

When the first high frequency pulse signal XCKN is at a high voltage level, voltage on the reference point K(N) is raised to a high voltage level, thus the sixth transistor T10, the seventh transistor T9 and the eighth transistor T25 are turned on, holding the low voltage level of the reference point Q(n), the transferring signal ST(N) of the current stage and the scan signal G(N) of the current stage.

When the second high frequency pulse signal CKN is at a high voltage level, voltage on the reference point P(n) is raised to a high voltage level, thus the fourteenth transistor T11, the fifteenth transistor T12 and the sixteenth transistor T26 are turned on, holding the low voltage level of the reference point Q(n), transferring signal ST(N) of the current stage and the scan signal G(N) of the current stage.

Given that when the first transistor T1 is turned on, the second bootstrap capacitor Cb2 is already at a higher voltage level, therefore the second bootstrap Cb2 can quickly charge the first bootstrap Cb so that voltage applied on the reference point Q(n) can be elevated and held at a higher voltage level. Therefore in the preferred embodiment, the structure of the pull controlling module 201 of the scan driving circuit 20 can elevate the voltage level of the reference point Q(n) faster, and hold the high voltage level of the reference point Q(n) longer, so to avoid any change in the voltage level of the reference point Q(n) due to leakage of transistors.

By utilizing the pull controlling module with the second bootstrap capacitor, the scan driving circuit of the present invention is able to avoid current leakage and elevate the reliability of the scan driving circuit.

Figure 4:
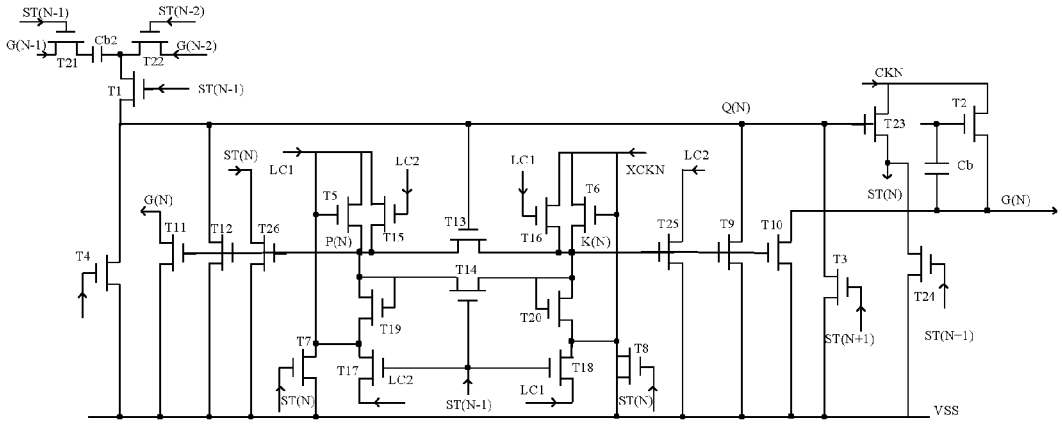
FIG. 4 is circuit diagram of a scan driving circuit according to a second preferred embodiment of the present invention.
Figure 5:
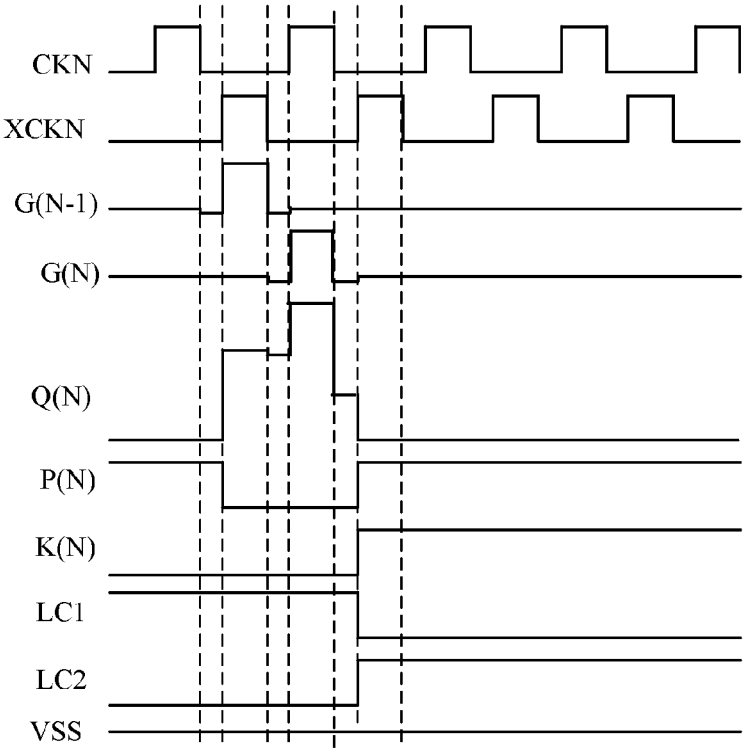
FIG. 5 shows waveforms of signals applied on the scan driving circuit according to the second preferred embodiment of the present invention.

Please refer to FIG. 4 and FIG. 5. FIG. 4 is circuit diagram of a scan driving circuit according to a second preferred embodiment of the present invention. FIG. 5 shows waveforms of signals applied on the scan driving circuit according to the second preferred embodiment of the present invention. The differences between this preferred embodiment and the first preferred embodiment are the first high frequency pulse signal XCKN is replaced by a first low frequency level signal LC2, the second high frequency pulse signal CKN is replaced by a second low frequency level signal LC1. The first low frequency level signal LC2 and the second low frequency level signal LC1 can change their voltage levels after several frames or a dozen frames, so as to lower pulse transitions and power consumption for the scan driving circuit.

The scan driving circuit proposed by this invention installed the second bootstrap capacitor in the pull controlling module, so to avoid current leakage and elevate the reliability of the scan driving circuit. It solves the technical problem resulted from the tendency to leak with existing scan driving circuits that also undermine the reliability of circuits.

The present disclosure is described in detail in accordance with the above contents with the specific preferred examples. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

What is claimed is:

1. A scan driving circuit for driving a plurality of scan lines, comprising:

a pull controlling module for receiving a transferring signal from a previous one stage and a transferring signal from a previous two stage, and for generating scan level signal based on the transferring signal from the previous one stage and the transferring signal from the previous two stage;

a pull-up module, for pulling up scan signal of one of the plurality of scan lines based on the scan level signal and a clock signal at a current stage;

a pull-down module, for pulling down the scan signal based on a transferring signal of a next stage;

a pull-down holding module, for holding the scan signal at a low level;

a transferring module, for sending a transferring signal of the current stage to a pull controlling module at the next stage;

a first bootstrap capacitor, for generating a high voltage level for the scan signal;

a constant low voltage level source for supplying low voltage level to pull down; and a reset module for reset operation of the scan level signal at the current stage;

wherein the pull controlling module comprises:

a second bootstrap capacitor for pre-pulling up the scan level signal through the transferring signal from the previous two stage, and pulling up the scan level signal through the transferring signal from the previous one stage;

a first transistor, comprising a controlling terminal receiving the transferring signal from the previous one stage, an input terminal connecting to the second bootstrap capacitor, and an output terminal connecting to the pull-up module, the pull-down module, the pull-down holding module, the transferring module and the second bootstrap capacitor.

2. The scan driving circuit of claim 1, wherein the pull controlling module further comprises a pre-pulling transistor and a pulling transistor;

a controlling terminal of the pre-pulling transistor is coupled to the transferring signal of the previous two stage, an input terminal of the pre-pulling transistor is coupled to the transferring signal of the previous two stage, and an output terminal of the pre-pulling transistor is connected to one end of the second bootstrap capacitor and the input terminal of the first transistor;

a controlling terminal of the pulling transistor is coupled to the transferring signal of the previous one stage; an input terminal of the pulling transistor is coupled to the transferring signal of the previous one stage, and an output terminal of the pulling transistor is connected to an other end of the second bootstrap capacitor.

3. The scan driving circuit of claim 1, wherein the pull-up module comprises a second transistor comprising a controlling terminal connecting to the output terminal of the first transistor of the pull controlling module, an input terminal for receiving the clock signal of the current stage, and an output terminal for outputting the scan signal of the current stage.

4. The scan driving circuit of claim 1, wherein the transferring module comprises a third transistor comprising a controlling terminal connecting to the output terminal of the first transistor of the pull controlling module, an input terminal for receiving the clock signal of the current stage, and an output terminal for outputting the transferring signal of the current stage.

5. The scan driving circuit of claim 1, wherein the pull-down module comprises a fourth transistor comprising a controlling terminal for receiving the transferring signal of the next stage, an input terminal connecting to the output terminal of the first transistor of the pull controlling module, and an output terminal connecting to the constant low voltage level source.

6. The scan driving circuit of claim 1, wherein the pull-down module comprises a fifth transistor comprising a controlling terminal for receiving the transferring signal of the next stage, an input terminal connecting to the output terminal of the third transistor, and an output terminal connecting to the constant low voltage level source.

7. The scan driving circuit of claim 1, wherein the pull-down holding module comprises a first pull-down holding unit, a second pull-down holding unit, a twenty-second transistor and a twenty-third transistor;

the twenty-second transistor comprises a controlling terminal connected to the output terminal of the first transistor, an output terminal connected to a reference point K(N), and an input terminal connected to a reference point P(N);

the twenty-third transistor comprises a controlling terminal receiving the transferring signal of the previous one stage, an output terminal connected to the reference point K(N), and an input terminal connected to the reference point P(N);

the first pull-down holding unit comprises a sixth transistor, a seventh transistor, an eighth transistor, a ninth transistor, a tenth transistor, an eleventh transistor, a twelfth transistor, and a thirteenth transistor;

the sixth transistor comprises a controlling terminal connected to the reference point K(N), an input terminal connected to the constant low voltage level source, and an output terminal connected to the output terminal of the second transistor;

the seventh transistor comprises a controlling terminal connected to the reference point K(N), an input terminal connected to the constant low voltage level source, and an output terminal connected to the output terminal of the first transistor;

the eighth transistor comprises a controlling terminal connected to the reference point K(N), an input terminal connected to the constant low voltage level source, and an output terminal coupled to the transferring signal of the current stage;

the ninth transistor comprises a controlling terminal coupled to a first pulse signal, an input terminal coupled to the first pulse signal, and an output terminal connected to the reference point K(N);

the tenth transistor comprises a controlling terminal coupled to the transferring signal of the current stage, an input terminal connected to the constant low voltage level source, and an output terminal coupled to the first pulse signal;

the eleventh transistor comprises a controlling terminal coupled to a second pulse signal, the input terminal coupled to the first pulse signal, and an output terminal connected to the reference point K(N);

the twelfth transistor comprises a controlling terminal connected to the reference point K(N), an output terminal connected to reference point K(N), and an input terminal coupled to the first pulse signal;

the thirteenth transistor comprises a controlling terminal receiving the transferring signal of the previous one stage, an input terminal coupled to the first pulse signal, and an output terminal coupled to the second pulse signal;

the second pull-down holding unit comprises a fourteenth transistor, a fifteenth transistor, a sixteenth transistor, a seventeenth transistor, an eighteenth transistor, a nineteenth transistor, a twentieth transistor, and a twenty-first transistor;

the fourteenth transistor comprises a controlling terminal connected to the reference point P(N), an input terminal connected to the constant low voltage level source, and an output terminal connected to the output terminal of the second transistor;

the fifteenth transistor comprises a controlling terminal connected to the reference point P(N), an input terminal connected to the constant low voltage level source, and an output terminal connected to the output terminal of the first transistor;

the sixteenth transistor comprises a controlling terminal connected to the reference point P(N), an input terminal connected to the constant low voltage level source, and an output terminal coupled to the transferring signal of the current stage;

the seventeenth transistor comprises a controlling terminal coupled to the second pulse signal, an input terminal coupled to the second pulse signal, and an output terminal connected to the reference point P(N);

the eighteenth transistor comprises a controlling terminal coupled to the transferring signal of the current stage, an input terminal connected to the constant low voltage level source, and an output terminal coupled to the second pulse signal;

the nineteenth transistor comprises a controlling terminal connected to the first pulse signal, an input terminal coupled to the second pulse signal, and an output terminal connected to the reference point P(N);

the twentieth transistor comprises a controlling terminal connected to the reference point P(N), an output terminal connected to the reference point P(N), and an input terminal coupled to the second pulse signal;

the twenty-first transistor comprises a controlling terminal receiving the transferring signal of the previous one stage, an input terminal coupled to the second pulse signal, and an output terminal coupled to the first pulse signal.

8. The scan driving circuit of claim 7, wherein a voltage level of the first pulse signal is opposite to a voltage level of the second pulse signal.

9. The scan driving circuit of claim 8, wherein the first pulse signal and second pulse signal are high frequency pulse signal or low voltage level signal.

10. A scan driving circuit for driving a plurality of scan lines, comprising:

a pull controlling module for receiving a transferring signal from a previous one stage and a transferring signal from a previous two stage, and for generating scan level signal based on the transferring signal from the previous one stage and the transferring signal from the previous two stage;

a pull-up module, for pulling up scan signal of one of the plurality of scan lines based on the scan level signal and a clock signal at a current stage;

a pull-down module, for pulling down the scan signal based on a transferring signal of a next stage;

a pull-down holding module, for holding the scan signal at a low level;

a transferring module, for sending a transferring signal of the current stage to a pull controlling module at the next stage;

a first bootstrap capacitor, for generating a high voltage level for the scan signal; and a constant low voltage level source for supplying low voltage level to pull down, wherein the pull controlling module comprises:

a second bootstrap capacitor for pre-pulling up the scan level signal through the transferring signal from the previous two stage, and pulling up the scan level signal through the transferring signal from the previous one stage, wherein the pull controlling module further comprises:

a first transistor, comprising a controlling terminal receiving the transferring signal from the previous one stage, an input terminal connecting to the second bootstrap capacitor, and an output terminal connecting to the pull-up module, the pull-down module, the pull-down holding module, the transferring module and the second bootstrap capacitor.

11. The scan driving circuit of claim 10, wherein the pull controlling module further comprises a pre-pulling transistor and a pulling transistor;

a controlling terminal of the pre-pulling transistor is coupled to the transferring signal of the previous two stage, an input terminal of the pre-pulling transistor is coupled to the transferring signal of the previous two stage, and an output terminal of the pre-pulling transistor is connected to one end of the second bootstrap capacitor and the input terminal of the first transistor;

a controlling terminal of the pulling transistor is coupled to the transferring signal of the previous one stage; an input terminal of the pulling transistor is coupled to the transferring signal of the previous one stage, and an output terminal of the pulling transistor is connected to an other end of the second bootstrap capacitor.

12. The scan driving circuit of claim 10, wherein the pull-up module comprises a second transistor comprising a controlling terminal connecting to the output terminal of the first transistor of the pull controlling module, an input terminal for receiving the clock signal of the current stage, and an output terminal for outputting the scan signal of the current stage.

13. The scan driving circuit of claim 10, wherein the transferring module comprises a third transistor comprising a controlling terminal connecting to the output terminal of the first transistor of the pull controlling module, an input terminal for receiving the clock signal of the current stage, and an output terminal for outputting the transferring signal of the current stage.

14. The scan driving circuit of claim 10, wherein the pull-down module comprises a fourth transistor comprising a controlling terminal for receiving the transferring signal of the next stage, an input terminal connecting to the output terminal of the first transistor of the pull controlling module, and an output terminal connecting to the constant low voltage level source.

15. The scan driving circuit of claim 10, wherein the pull-down module comprises a fifth transistor comprising a controlling terminal for receiving the transferring signal of the next stage, an input terminal connecting to the output terminal of the third transistor, and an output terminal connecting to the constant low voltage level source.

16. The scan driving circuit of claim 10, wherein the pull-down holding module comprises a first pull-down holding unit, a second pull-down holding unit, a twenty-second transistor and a twenty-third transistor;

the twenty-second transistor comprises a controlling terminal connected to the output terminal of the first transistor, an output terminal connected to a reference point K(N), and an input terminal connected to a reference point P(N);

the twenty-third transistor comprises a controlling terminal receiving the transferring signal of the previous one stage, an output terminal connected to the reference point K(N), and an input terminal connected to the reference point P(N);

the first pull-down holding unit comprises a sixth transistor, a seventh transistor, an eighth transistor, a ninth transistor, a tenth transistor, an eleventh transistor, a twelfth transistor, and a thirteenth transistor;

the sixth transistor comprises a controlling terminal connected to the reference point K(N), an input terminal connected to the constant low voltage level source, and an output terminal connected to the output terminal of the second transistor;

the seventh transistor comprises a controlling terminal connected to the reference point K(N), an input terminal connected to the constant low voltage level source, and an output terminal connected to the output terminal of the first transistor;

the eighth transistor comprises a controlling terminal connected to the reference point K(N), an input terminal connected to the constant low voltage level source, and an output terminal coupled to the transferring signal of the current stage;

the ninth transistor comprises a controlling terminal coupled to a first pulse signal, an input terminal coupled to the first pulse signal, and an output terminal connected to the reference point K(N);

the tenth transistor comprises a controlling terminal coupled to the transferring signal of the current stage, an input terminal connected to the constant low voltage level source, and an output terminal coupled to the first pulse signal;

the eleventh transistor comprises a controlling terminal coupled to a second pulse signal, the input terminal coupled to the first pulse signal, and an output terminal connected to the reference point K(N);

the twelfth transistor comprises a controlling terminal connected to the reference point K(N), an output terminal connected to reference point K(N), and an input terminal coupled to the first pulse signal;

the thirteenth transistor comprises a controlling terminal receiving the transferring signal of the previous one stage, an input terminal coupled to the first pulse signal, and an output terminal coupled to the second pulse signal;

the second pull-down holding unit comprises a fourteenth transistor, a fifteenth transistor, a sixteenth transistor, a seventeenth transistor, an eighteenth transistor, a nineteenth transistor, a twentieth transistor, and a twenty-first transistor;

the fourteenth transistor comprises a controlling terminal connected to the reference point P(N), an input terminal connected to the constant low voltage level source, and an output terminal connected to the output terminal of the second transistor;

the fifteenth transistor comprises a controlling terminal connected to the reference point P(N), an input terminal connected to the constant low voltage level source, and an output terminal connected to the output terminal of the first transistor;

the sixteenth transistor comprises a controlling terminal connected to the reference point P(N), an input terminal connected to the constant low voltage level source, and an output terminal coupled to the transferring signal of the current stage;

the seventeenth transistor comprises a controlling terminal coupled to the second pulse signal, an input terminal coupled to the second pulse signal, and an output terminal connected to the reference point P(N);

the eighteenth transistor comprises a controlling terminal coupled to the transferring signal of the current stage, an input terminal connected to the constant low voltage level source, and an output terminal coupled to the second pulse signal;

the nineteenth transistor comprises a controlling terminal connected to the first pulse signal, an input terminal coupled to the second pulse signal, and an output terminal connected to the reference point P(N);

the twentieth transistor comprises a controlling terminal connected to the reference point P(N), an output terminal connected to the reference point P(N), and an input terminal coupled to the second pulse signal;

the twenty-first transistor comprises a controlling terminal receiving the transferring signal of the previous one stage, an input terminal coupled to the second pulse signal, and an output terminal coupled to the first pulse signal.

17. The scan driving circuit of claim 10, wherein a voltage level of the first pulse signal is opposite to a voltage level of the second pulse signal.

18. The scan driving circuit of claim 17, wherein the first pulse signal and second pulse signal are high frequency pulse signal or low voltage level signal.

19. The scan driving circuit of claim 10, further comprising a reset module for reset operation of the scan level signal at the current stage.

* * * * *